US009878729B2

(12) United States Patent
Bartek et al.

(10) Patent No.: US 9,878,729 B2
(45) Date of Patent: Jan. 30, 2018

(54) FAILSAFE RAIL MOUNTED SHUNT DEVICE

(71) Applicant: HARSCO TECHNOLOGIES LLC, Fairmont, MN (US)

(72) Inventors: Peter Michael Bartek, Ledgewood, NJ (US); Michael Stephen Davis, Westminister, MD (US)

(73) Assignee: HARSCO TECHNOLOGIES LLC, Fairmont, MN (US)

( * ) Notice: Subject to any disclaimer, the term of this patent is extended or adjusted under 35 U.S.C. 154(b) by 243 days.

(21) Appl. No.: 14/873,589

(22) Filed: Oct. 2, 2015

(65) Prior Publication Data

US 2016/0096538 A1 Apr. 7, 2016

Related U.S. Application Data

(60) Provisional application No. 62/071,816, filed on Oct. 3, 2014, provisional application No. 62/215,858, filed on Sep. 9, 2015.

(51) Int. Cl.

| | |
|---|---|
| ***B61L 23/16*** | (2006.01) |
| ***B61L 23/20*** | (2006.01) |
| ***B61L 23/34*** | (2006.01) |
| ***B61L 27/00*** | (2006.01) |
| ***B61L 23/00*** | (2006.01) |
| ***B61L 23/06*** | (2006.01) |

(Continued)

(52) U.S. Cl.

CPC ..... *B61L 23/16* (2013.01); *B61L 1/18* (2013.01); *B61L 23/00* (2013.01); *B61L 23/06* (2013.01); *B61L 23/20* (2013.01); *B61L 23/34* (2013.01); *B61L 25/025* (2013.01); *B61L 27/0005* (2013.01); *B61L 27/0088* (2013.01); *B61L 2205/04* (2013.01)

(58) Field of Classification Search

CPC ..... B61L 23/04; B61L 1/18; B61L 1/184

See application file for complete search history.

(56) References Cited

U.S. PATENT DOCUMENTS 2,930,887 A * 3/1960 Duteil ..... B61L 1/188 246/34 R 6,533,222 B1 * 3/2003 Brooks ..... B61L 1/183 246/25

(Continued)

FOREIGN PATENT DOCUMENTS

CN 103569159 2/2014

OTHER PUBLICATIONS

Federal Transit Administration, "Safety Advisory 14-1: Right-of-Way Worker Protection." pp. 1-37, Dec. 19, 2013, See pp. 1-2, 6-9 and 36.

(Continued)

*Primary Examiner* — Jason C Smith

(74) *Attorney, Agent, or Firm* — Baker & McKenzie LLP

(57) ABSTRACT

The present disclosure generally relates to shunt devices for providing multi-fold protection for track workers. For example, a failsafe shunt device may have a pair of end components magnetically couple to two running rails and a central unit connected to the pair of end components via electrical wires. The failsafe shunt device may communicate with an operations control center (OCC) to indicate a presence of the shunt device. Related methods of using disclosed shunt devices and associated systems are also described.

20 Claims, 4 Drawing Sheets

(51) Int. Cl.
*B61L 25/02* (2006.01)
*B61L 1/18* (2006.01)

(56) References Cited

U.S. PATENT DOCUMENTS 7,363,187 B2 * 4/2008 Winkler ..... B61L 21/04 246/146
2002/0190811 A1 * 12/2002 Sperber ..... H04B 3/143 333/28 R
2008/0296441 A1 * 12/2008 Anderson ..... B61L 23/044 246/121
2010/0219256 A1 * 9/2010 Williams ..... H01R 13/6205 238/14.05
2013/0261842 A1 * 10/2013 Cooper ..... B61L 15/0081 701/1
2013/0284859 A1 * 10/2013 Polivka ..... B61L 27/0055 246/34 R
2014/0042993 A1 * 2/2014 Nagel ..... H02P 3/14 323/223
2014/0263858 A1 * 9/2014 Hogan ..... B61L 1/187 246/125
2014/0350767 A1 * 11/2014 Fries ..... B61L 27/0077 701/23
2015/0179003 A1 * 6/2015 Cooper ..... B60L 3/10 701/31.4
2015/0307117 A1 * 10/2015 Noffsinger ..... B61L 23/044 246/121
2016/0075356 A1 * 3/2016 Kull ..... B61L 23/044 246/121
2016/0090113 A1 * 3/2016 Nagrodsky ..... B61L 23/04 246/34 R
2016/0096538 A1 * 4/2016 Bartek ..... B61L 23/00 246/28 R

OTHER PUBLICATIONS

International Search Report and Written Opinion for PCT/US2015/053708 dated Feb. 24, 2016.

* cited by examiner

FAILSAFE RAIL MOUNTED SHUNT DEVICE

CROSS-REFERENCE TO RELATED APPLICATIONS

This application claims priority to U.S. Provisional Application No. 62/071,816, filed Oct. 3, 2014 and entitled "Failsafe Rail Mounted Shunt Device," and to U.S. Provisional Application No. 62/215,858, filed Sep. 9, 2015 and entitled "Failsafe Rail Mounted Shunt Device," both of which are hereby incorporated by reference in their entirety.

BACKGROUND

Railroads are generally constructed of a pair of elongated, substantially parallel rails, which are coupled to a plurality of laterally extending ties via metal tie plates and spikes and/or spring clip fasteners. After construction railroads may require regular maintenance. When maintaining a railroad, track workers often need to work around and between the rails. Thus, it is important to have robust roadway worker protection systems to promote worker safety. For example, a shunt device may be mounted on two running rails of a work zone to form a close circuit between the two rails. If properly installed, the shunt device may indicate the close-circuit status to an operations control center (OCC). The OCC may detect the shunt device by treating it as a train, which also creates a short circuit between two rails. Thus, the shunt device may prevent railcars or locomotives from entering an occupied work area.

Existing shunt devices may be secured onto two running rails by clamp-type devices. However, a shunt device may not always be operational after its installation. For example, a shunt device may not be correctly clamped onto the rails, or an onsite worker may trip on a wire on the shunt device and disconnect it from the rails. Despite the possibility of a faulty connection or other error, onsite workers often assume that a shunt device would be operational once installed. In existing shunt devices, there may be no alert or warning if a shunt device is removed without authorization, which creates a potential safety hazard to onsite workers. Accordingly, it is desirable to improve functions of rail-mounted shunt devices for increased safety.

BRIEF SUMMARY

The present disclosure generally relates to providing multi-fold protection for track workers using a rail-mounted shunt device (sometimes called shunting device). According to some aspects of the present disclosure, a shunt device may be magnetically coupled to both running rails via two magnetic end components. A shunt device may have a central unit connected to end components via two electrical wires. On-board circuitry may be implemented in the central unit for various functions such as transmitting and receiving signals and indicating whether the shunting device is operational. When properly installed, a shunt device may send signals to an operations control center (OCC) to indicate a presence of the shunt device, and the OCC may display a track occupancy light (TOL) to indicate that the track section is occupied. Accordingly, a shunt device disclosed herein may prevent rail vehicles from entering occupied work area(s). The purpose is to provide a safe procedure for track access in order to perform track maintenance or repair in fixed or moving work zones during revenue hours or with test trains or maintenance vehicles operating during repair.

The present disclosure teaches shunt devices that have self-diagnosis capabilities, making them "failsafe." For example, a failsafe shunt device may be equipped with visual and/or audio alarms that issue warnings to surrounding rail workers when the shunt device stops being properly connected to both rails or when a rail vehicle is approaching. Shunt devices disclosed herein may work seamlessly with positive train control (PTC) technologies. For example, a shunt device may communicate with a control center either directly or indirectly through wayside communications systems. Related methods for using the disclosed shunt devices are also described.

BRIEF DESCRIPTION OF THE DRAWINGS

Reference is now made to the following descriptions taken in conjunction with the accompanying drawings.

DETAILED DESCRIPTION

Various embodiments of a failsafe rail-mounted shunt device and associated procedures and methods of using such shunt device according to the present disclosure are described. It is to be understood, however, that the following explanation is merely exemplary in describing the devices and methods of the present disclosure. Accordingly, several modifications, changes and substitutions are contemplated.

Figure 1:
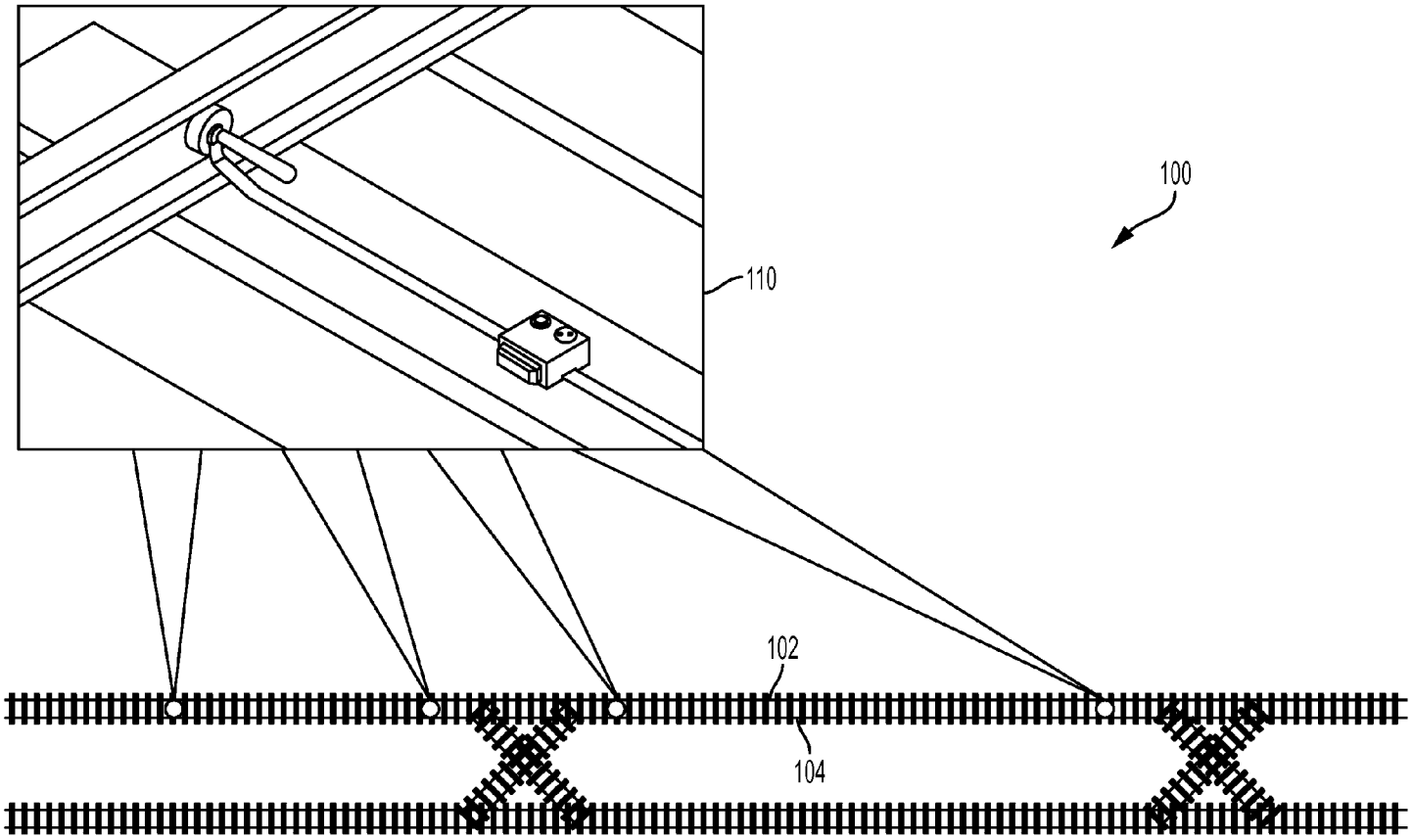
FIG. 1 illustrates a perspective view of a railroad section with an exemplary failsafe shunt device according to the present disclosure deployed therein.

FIG. 1 is a schematic diagram illustrating a railroad section 100 in which exemplary embodiments of failsafe shunt devices 110 are deployed. Although the present disclosure uses railroad as an example application, the disclosed principles may be similarly applied to any other appropriate industrial setting. As shown in FIG. 1, the railroad section 100 may comprise one or more work zones, in which failsafe shunt devices 110 may be deployed at various locations. Each work zone may have one or more failsafe shunt devices 110, and each failsafe shunt device 110 may be mounted on and between two running rails including a first rail 102 and a second rail 104.

Figure 2:
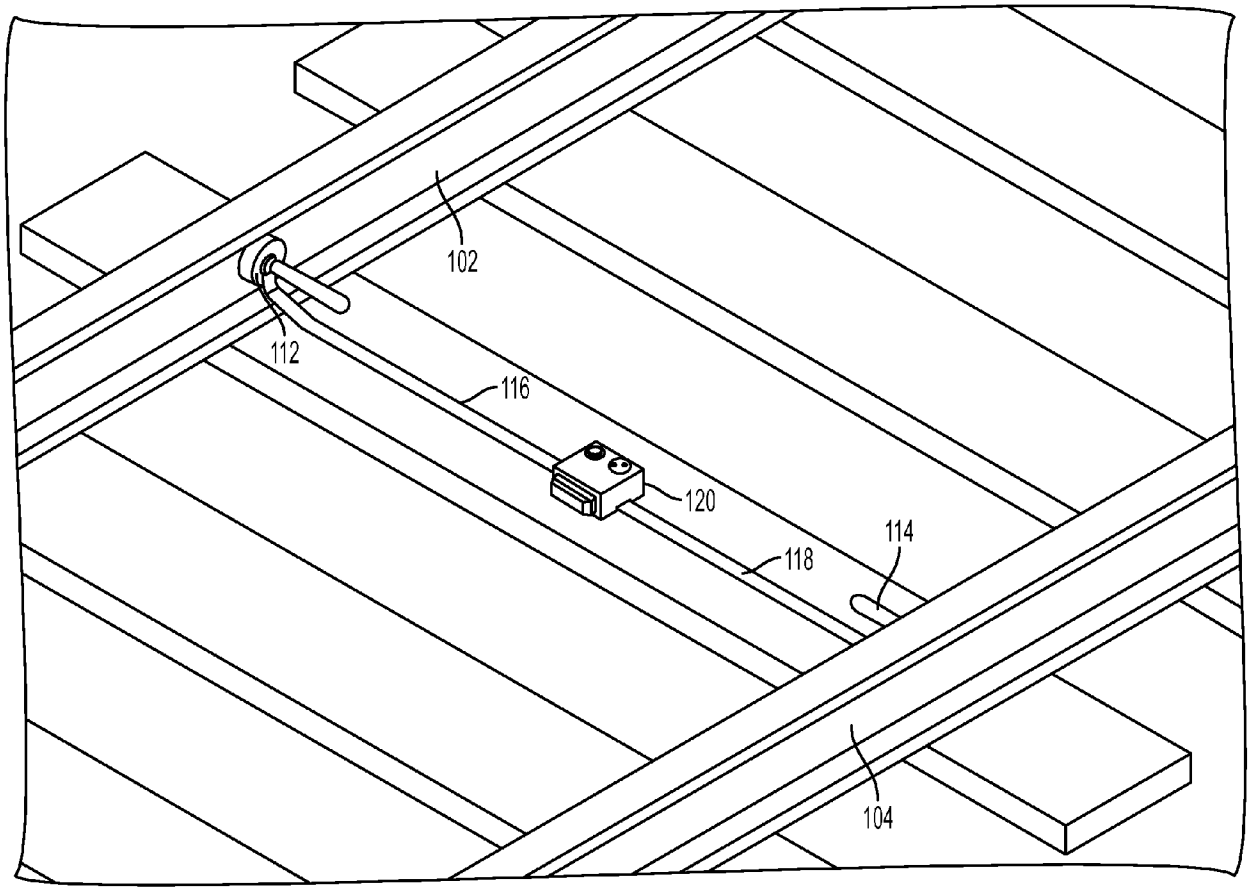
FIG. 2 illustrates a close-up perspective view of the failsafe shunt device of FIG. 1.

FIG. 2 provides a close-up view of an example embodiment of the failsafe shunt device 110, which is mounted on the rails 102 and 104. As shown in FIG. 2, the failsafe shunt device 110 may comprise two end components (or units) 112 and 114 a central unit 120 located therebetween. A first end component 112 may be connected to the central unit 120 via a first electrical wire 116, and a second end component 114 may be connected to the central unit 120 via a second electrical wire 118.

At least one of the end components 112 and 114 may be implemented a magnet, which may be made of any suitable magnetic, conductive material. In an embodiment, the failsafe shunt device 110 may attach magnetically to the web of both running rails 102 and 104 via the end components 112 and 114. The magnets may take any suitable shape as well. For example, as shown in FIG. 2 the end component 112 may comprise a cylindrical magnetic piece and a cylindrical handle, which is attached to (and smaller in diameter than) the cylindrical magnetic piece. Magnetic coupling disclosed herein has advantages over traditional clamping, since the magnetic end components 112 and 114 may enable workers to install and remove the failsafe shunt device 110 more quickly. Further, the failsafe shunt device 110 may be lighter in weight than traditional clamp-type shunt devices.

Electrical wires 116 and 118 may provide electrical connection between the end components and the central unit 120. Upon proper magnetic coupling, the failsafe shunt device 110 may form an electrical connection between the rails 102 and 104 (similar to a short circuit), which creates the "shunting."

The central unit 120 may comprise an electronic board, where on-board circuitry may be implemented for various functions. For example, on-board circuitry may indicate whether the shunting device 110 is correctly installed and operational. In an embodiment, the operational status may be indicated by a green light (or any other signaling mechanism) on the central unit 120. The central unit 120 may comprise one or more transceivers (transmitter and/or receiver) for communication with other devices such as an operations control center (OCC), a rail vehicle, or a wayside communications system. The central unit 120 may comprise other components such as a switch to turn on/off the shunt device 110, a rotary dial to change communication mode, and so forth.

Figure 3:
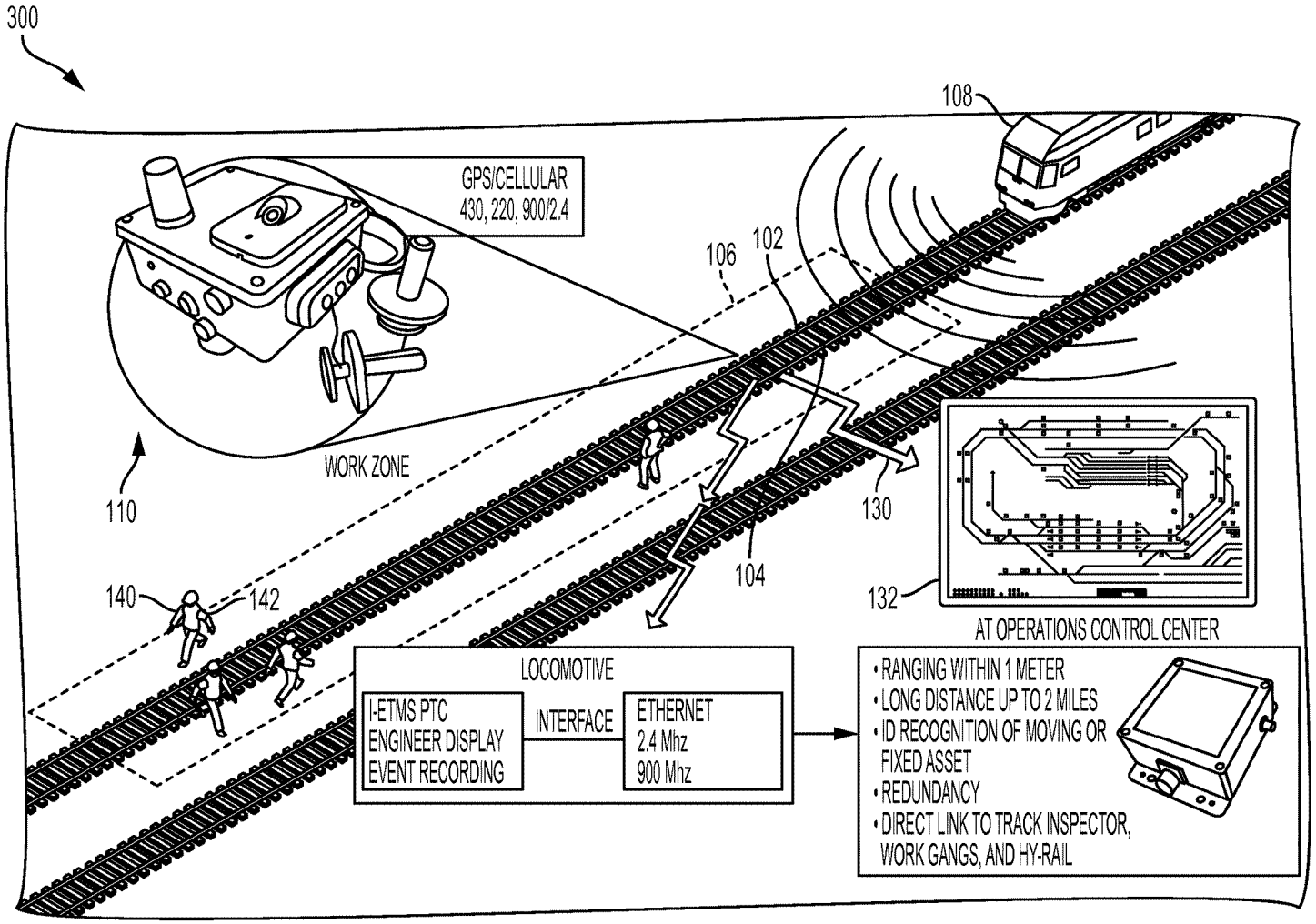
FIG. 3 illustrates a perspective view of an exemplary railroad worker protection system according to the present disclosure using the failsafe shunt device of FIG. 1.

FIG. 3 is a schematic diagram illustrating an example embodiment of a railroad worker protection system 300 using the failsafe shunt device 110. As shown in FIG. 3, several track workers may be performing maintenance work in a work zone 106. In an embodiment, the failsafe shunt device 110 may be mounted on and between the first rail 102 and the second rail 104.

In practice, after the failsafe shunt device 110 is properly installed in the work zone 106, the failsafe shunt device 110 may send one or more signals 130 to an OCC (not pictured). A signal 130 may take any suitable data format, and may be sent continuously, or periodically, or only upon installation and removal of the failsafe shunt device 110. An operations control center may be located remotely from the work zone 106, and may be implemented as any rail control center that can communicate with the failsafe shunt device 110 and other rail vehicles. Upon receiving the signals 130 from the failsafe shunt device 110, an OCC may indicate the presence of the shunt device 110 on a screen 132. For example, the failsafe shunt device 110 may be displayed on the screen 132 as a track occupancy light (TOL). In some embodiments, the presence is indicated such that the failsafe shunt device 110 can be distinguished from a rail vehicle.

Rail vehicles such as railcars or locomotives are often equipped with Automatic Train Protection (ATP) systems that communicate with an OCC. Therefore, the failsafe shunt device 110 prevents operators of railcars or locomotives from obtaining proper authorization to enter corresponding work area(s). Suppose, for example, a rail vehicle 108 (e.g., a train, locomotive, or railcar, etc.) is traveling along the rails 102 and 104 and approaching the failsafe shunt device 110. According to some aspects of the present disclosure, the rail vehicle 108 may be stopped from entering the work zone 106, because an OCC would notify in advance the rail vehicle 108 of the presence of the failsafe shunt device 110. For example, a rail employee at the OCC may stop routing trains or other vehicles into the work zone 106. Consequently, train operators may not get proper wayside indication (e.g., green lights) to enter the work zone 106, where the failsafe shunt device 110 resides. Additionally or alternatively, the failsafe shunt device 110 may communicate directly with the oncoming rail vehicle 108 (e.g., at certain distances) to warn the latter of its presence. Visual and/or audio alarming components on the central unit 120 may also be picked up by the rail vehicle 108. Such features may provide an extra layer of safety.

Positive train control (PTC) is a system of functional requirements, currently under development, for monitoring and controlling train movements in order to provide increased safety. In an embodiment, the failsafe shunt device 110 may work seamlessly with PTC technologies in its communications with rail vehicles and/or with a control center (e.g., OCC). For example, the failsafe shunt device 110 may have transceivers that work near (at and/or close to) various frequencies such as 430 MHz, 220 MHz, 900 MHz, 2.4 GHz, 2.4 MHz, global positioning system (GPS) frequencies, and cellular frequencies. The 220 MHz is a Federal Communications Commission (FCC)-approved frequency band for PTC communications. The shunt device 110 may communicate with a control center directly through GPS communication links or cellular communication links. Since the failsafe shunt device 110 is electrically connected to both rails, the failsafe shunt device 110 may also send a signal to a control center via the running rails (e.g., at 35 volts DC).

In geographical areas where there is no wireless signal (sometimes referred to as dark territories), the failsafe shunt device 110 may communicate with a control center indirectly through wayside communications systems such as a signaling tower or a bungalow. Such wayside communications systems may be deployed along a railroad to serve as an intermediary communications link. For example, a wayside communications system may receive signals 130 from the failsafe shunt device 110 via the rails or wirelessly. In turn, the wayside communications system may relay the signals 130 to a control center (directly or through other relay systems) to indicate the presence of the shunt device 110.

According to some aspects of the present disclosure, the failsafe shunt device 110 may communicate with rail vehicles (e.g., wirelessly around a 400 MHz radio link, or via the running rails). For example, when the rail vehicle 108 is approaching the work zone 106, the failsafe shunt device 110 may start to issue alarms at pre-determined distances. The rail vehicle 108 may communicate in turn with a control center to confirm how far the train is from the work zone 106. If the rail vehicle 108 gets too close, mandatory braking may be enforced to prevent potential danger to onsite workers.

The failsafe shunt device 110 may be a proactive shunt strap equipped with a self-diagnosis system. For example, the failsafe shunt device 110 may be equipped with visual and/or audio alarms that can be recognized by surrounding devices and workers. In an embodiment, when someone disconnects the failsafe shunt device 110 without proper authorization (e.g., accidentally, intentionally, or inadvertently), the visual and/or audio alarms may be triggered. For example, there may be a flashing light and a loud alarm on the central unit 120. The warning messages may be picked up by surrounding personnel.

Members of the onsite work crew, such as worker 140, may be equipped with personal alert devices 142 that communicate wirelessly with the failsafe shunt device 110. The personal alert devices may be carried as armband or on-head devices. For example, the worker 140 has an armband device 142 as his personal alert device. The failsafe shunt device 110 may send out a secure radio frequency (RF)

signal to wayside and/or personal devices within the output area, which may pick up the warning from the failsafe shunt device 110 in case of an unauthorized disconnection or an oncoming train. Thus, the failsafe shunt device 110 warns workers of the potential danger which the workers might not otherwise notice due to their concentration on their work and the high volume of noise. Features disclosed herein make the shunt devices "failsafe."

One of the issues with existing clamp-type shunting devices is that, from the perspective of a control center, a clamp-type shunting device may not be distinguishable from a rail vehicle such as a train. The present disclosure may implement shunting delay, e.g., by having on-board circuitry on the central unit 120 to alternatively switch the rail connection on (shunt) and off (no shunt). This signaling mechanism creates a blinking effect at the control center to indicate that the signal is arriving from a shunting device, not a rail vehicle. That is, the failsafe shunt device 110 may send a signal to a control center (or to another device) to specify the identity of the failsafe shunt device 110.

Although not depicted, the central unit 120 may further comprise a computer or data processing system that includes a processor configured to execute software program(s) stored in a memory for the purposes of performing one or more of the procedures and methods disclosed herein. A processor on the central unit 120 may be coupled to a communication interface to receive and to transmit data. For example, there may be a communication interface between the central unit 120 and another device (e.g., the rail vehicle 108) for Interoperable Electronic Train Management System (I-ETMS) PTC, engineer display, event recording, and/or other functions. Data communication may occur over interface via wired Ethernet or via wireless channels at 2.4 MHz or 900 MHz. The rail vehicle 108 may provide ranging within one meter as well as a long distance up to two miles. The rail vehicle 108 may provide ID recognition of a moving or fixed asset. There is a redundancy of warning mechanisms to provide enhanced safety. There may be a direct link from the rail vehicle 108 to a track inspector, work gangs, and hy-rail.

To work with embodiments of failsafe shunt devices disclosed herein, rail personnel including onsite workers and supervisors at an operations control center may adapt procedural changes. Work zone personnel responsibilities may include using rail-mounted failsafe shunt devices (sometimes referred to as shunt straps) as well as wearing portable warning horn and lights, and/or personal alert device(s) in work blocks for all types of track work. The procedural changes may provide a safer procedure for track access in order to perform track maintenance or repair in fixed or moving work zones during revenue hours or with test trains operating during repair.

According to some aspects of the present disclosure, a shift supervisor may authorize and assemble work maintenance crew to perform track work. The supervisor may select a qualified person of the work crew as the designated work crew coordinator to manage activities with the OCC and to provide on-track safety for all members of the work crew. Only a designated qualified person may request and initiate a track work area and should comply with safety procedures, policies, and standards in order to ensure optimum safety to all personnel.

According to some aspects of the present disclosure, work crew coordinator responsibilities may include the following:

1. Confirm that appropriate personnel are on site.
2. Confirm type of maintenance or repair with the shift supervisor and work crew.
3. Provide and supervise on-track safety guidelines for all crew members in and around the work area.
4. Possess, establish, and maintain adequate means of communications with OCC and the work crew throughout the maintenance operation.
5. Ensure proper clearance is obtained by OCC before entering the intended work area.
6. Ensure that all required safety devices—including failsafe rail-mounted portable shunt strap, portable warning horn and lights, and/or personal alert device—are obtained, tested, assigned, and positioned before work crew members enter any work area.
7. Coordinate all crew activities with OCC within the work area.
8. After completion of work, verify that all personnel and equipment are clear of the work area and accounted for and that the area is safe for train movement.

According to some aspects of the present disclosure, each individual crew member is responsible for following all on-track safety rules. All crew members will be required to adhere to all agency safety guidelines and personal protective equipment (PPE) requirements.

According to some aspects of the present disclosure, OCC employee responsibilities may include the following:

1. Establish and maintain adequate means of communication with the work crew through the designated qualified person throughout the maintenance operation.
2. Ensure proper clearance is given to the work crew through the designated qualified person before entering the intended work area.
3. Ensure that all required PPE failsafe rail mounted portable shunt straps, portable warning horn and lights, and/or personal alert device are turned on and in position before work crew members enter any work area.
4. Coordinate all crew activities with the work crew via the designated qualified persons.
5. After completion of work, verify that all personnel and equipment are clear of the work area and accounted for through the designated qualified per on and that the area is safe for train movement.

According to some aspects of the present disclosure, shift supervisor responsibilities may include the following:

1. Obtain the required work area protection safety technology equipment using failsafe rail mounted portable shunt straps, portable warning horn and lights, and/or personal alert device devices; perform an initial test of all equipment and warning devices, and ensure that all equipment and warning devices are properly signed-out according to agency procedures.
   a. Upon completion of initial function tests, turn off early warning devices in order to conserve power charge and prevent false warnings while moving to the designated work area.
2. Provide a job briefing to the work crew.
   a. Confirm attendance and duties of all assigned crew members.
   b. Specify location and nature of work/repair to be done.
   c. Specify safety guidelines and ensure proper PPE.
   d. Designate and assign duties to safety personnel (ex. flagger, watchperson, and lookout).
   e. Assign failsafe rail-mounted portable shunt straps, portable warning horn and lights, and/or personal alert device to personal and instruct where the devices will be needed.
      i. After assignment, the designated qualified person will ask all crew members, "are all personal warning devices turned on?" The designated qualified person will then perform a supervisory function test in order to confirm that all warning are turned on and functioning properly to provide a secondary means of track area protection.

f. Perform a test of all safety and warning devices.

3. Establish contact with OCC and request track access by the following procedure:
   a. Give radio number;
   b. Report number in work crew;
   c. State the location of the work area;
   d. State nature of work and/or repairs (e.g., specify "minor repair" if applicable);
   e. If necessary, request a speed restriction; and
   f. Confirm with OCC that all devices are turned on and functioning properly.
      i. OCC will see a TOL if the failsafe shunt strap is properly installed. If TOL is present OCC will inform the shift supervisor that the shunt strap is functioning properly.
4. Upon obtaining and confirming proper clearance from OCC, the designated qualified person will ensure the following:
   a. The crew possess adequate communications.
   b. Position failsafe rail mounted portable shunt straps, portable warning horn and lights, and/or personal alert device where appropriate.
5. Where applicable, place appropriate failsafe rail mounted portable shunt straps, portable warning horn and lights in the work area, as per agency guidelines, as a secondary means of track area protection. The failsafe rail mounted portable shunt straps, and portable warning horn and lights shall be positioned as per agency procedures and guidelines. Once the failsafe rail mounted portable shunt straps, and portable warning horn and lights are positioned in the work area, the designated qualified person will confirm with all crew members that all assigned devices are turned on.
   a. Ensure that all crew members are within voice communication range with the flagger(s)/watchperson(s)/lookout(s).
   b. Work will commence only after the designated qualified person has verified all information with OCC and has confirmed that all safety equipment and early warning device have been positioned, turned on and are functioning properly.
   c. The designated qualified person will notify OCC when any work crew member is not equipped with a personal alert device or portable warning horn/light warning device.
   d. Crew members will notify the designated qualified person when any device is placed out of service.
   e. The designated qualified person shall maintain communications with OCC and the work crew throughout the maintenance operation.
   f. Give an update to OCC when required to do so by SOP's. Update OCC if additional time is anticipated.
   g. Upon completion of track maintenance/repair, the designated qualified person will verify that all personnel and equipment are clear of tracks and accounted for and that the area is safe for train movement.
      i. Upon verification that the work block is clear of all tools, equipment, vehicles, and personnel, the designated qualified person shall confirm with all crew members that all assigned devices (failsafe rail mounted portable shunt straps, portable warning horn and lights and/or personal alert) are turned off in order to prevent false warnings.
      ii. The designated qualified person will then call OCC and indicate track area is clear of personnel and equipment and release to OCC.
      iii. The designated qualified person shall be responsible for the collection, accountability and proper return of all safety equipment and warning devices according to agency sign off procedures.

In terms of Work Crew Parameters, According to some aspects of the present disclosure, a maintenance crew will consist of a minimum of two employees except when supporting contractors or other departments. All crew members will adhere to all agency safety guidelines and PPE requirements. Crew members shall not be permitted in the work block until given permission by the designated qualified person. All crew members will establish and maintain voice communication with designated flagger(s)/watchperson(s)/lookout(s). All crew members shall adhere to all designated safety personnel and warning devices and leave the fouling space when required.

In terms of OCC Parameters, according to some aspects of the present disclosure, operations may not allow reverse traffic for any reason until the following conditions are met: (1) the work crew is notified; and (2) it is verified that all safety and warning equipment is in place as per agency procedures and guidelines. Prior to reversing traffic, OCC may ask the designated qualified person, "Are failsafe rail mounted portable shunt straps, portable warning horn and lights, and/or personal alert device turned on?" in order to confirm that all magnetically attached shunt straps are turned on and functioning properly. OCC must verify a "TOL".

The present disclosure describes a safe procedure for installing failsafe shunt straps isolating a section of track that will ensure safe working conditions for track workers from revenue trains, test trains, and potential human error.

According to some aspects of the present disclosure, the installation of failsafe shunt devices may follow certain procedures. For example, shunt straps may be used when a work area does not have a shunting vehicle, or when the shunting vehicle is moving throughout the work block. After confirming a work order, a designated qualified person shall install the required shunt strap. The shunt strap may be installed in the first track circuit, both ends, inside the approved work block area. Prior to installing the shunt strap, the designated qualified person will establish contact with OCC and request track access by the following procedure:

1. Give radio number.
2. Report number of works in a work crew.
3. State the location of the work area.
4. State nature of work and/or repairs; give estimated work time.
5. If necessary, request a speed restriction.

A. Once OCC grants permission the designated qualified person shall install the shunt strap and verify a good connection by:
   1 Verify with OCC that work block limits are shown as occupied at OCC (e.g., TOL is displayed).

B. If a TOL is displayed no further action is required.

C. The designated qualified person shall maintain communications with OCC and the work crew throughout the maintenance operation.

According to some aspects of the present disclosure, removal of the failsafe shunt devices may follow certain procedures. Prior to removing the shunt strap, the designated qualified person will establish contact with OCC and request track access and permission to remove shunt straps. Once OCC grants permission, the designated qualified person shall remove the shunt strap and thereafter verify with OCC that the TOL is off and that the area is not shown as occupied.

Figure 4:
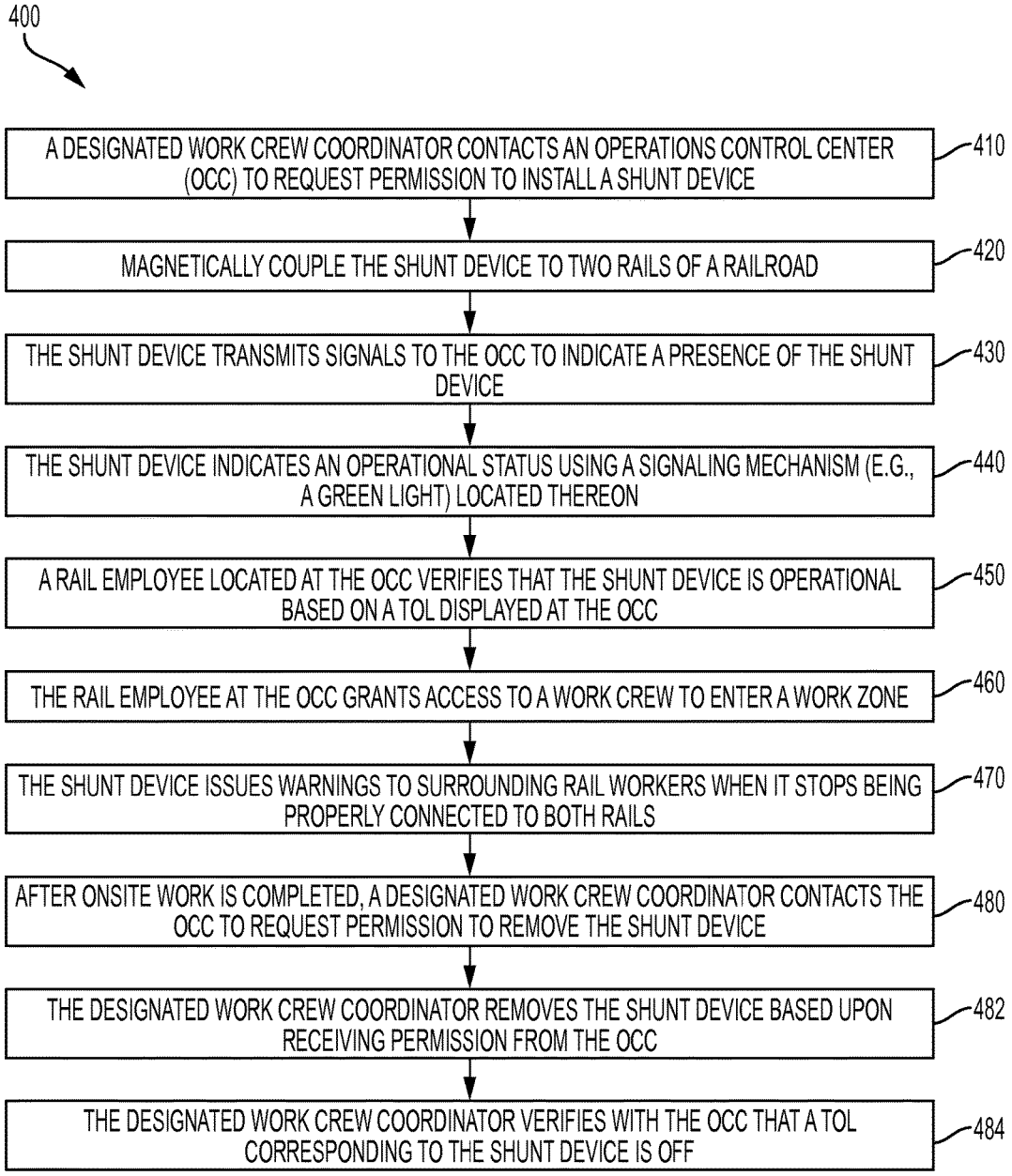
FIG. 4 is a flowchart illustrating a method of using the shunt device of FIG. 1 for PTC-compatible rail communications.

FIG. 4 is a flowchart illustrating a method 400 of using a shunt device for PTC-compatible rail communications. The method 400 may be implemented as part of procedures in worker protection systems to promote worker safety. To start off at action 410, a designated work crew coordinator may contact an OCC to request permission to install a shunt device. In an embodiment, for the permission request the designated work crew coordinator reports to the OCC various information including (but not limited to) a radio number, a location of work zone, a number of onsite workers, and nature of work.

At action 420, a shunt device (e.g., the failsafe shunt device 110) may be magnetically coupled to two rails of a railroad. At action 430, one or more signals may be transmitted from a shunt device to an OCC to indicate a presence of the shunt device. An identity of the shunt device may be specified to distinguish the device from rail vehicles (e.g., showing the shunt device as a blinking symbol at the OCC instead of a constant symbol). At action 440, a shunt device may indicate an operational status of the shunt device using a signaling mechanism (e.g., a green light) located thereon.

At action 450, a rail employee located at the OCC may verify that the shunt device is operational, and the verification may be based on a TOL displayed at the OCC. Upon verification, at action 460 the rail employee at the OCC may grant access to a work crew to enter a work zone and start working. At action 470, a shunt device may issue warnings to surrounding rail workers when the shunt device stops being properly connected to both rails. The shunt device may also issue warnings when there is an oncoming rail vehicle.

After onsite work is completed, at action 480, a designated work crew coordinator may contact the OCC to request permission to remove the shunt device. At action 482, the designated work crew coordinator may remove the shunt device based upon receiving permission from the OCC. After removal of the shunt device, at action 484 the designated work crew coordinator may verify with the OCC that a TOL corresponding to the shunt device is off (i.e., the work zone is now clear).

While various embodiments of rail-mounted shunt devices and related methods of using such devices have been described above, it should be understood that they have been presented by way of example only, and not limitation. Thus, the breadth and scope of the present disclosure should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, the description of a technology in the "Background" is not to be construed as an admission that technology is prior art to any invention(s) in this disclosure. Neither is the "Brief Summary" to be considered as a characterization of the invention(s) set forth in the claims found herein. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A shunt device for railroad use comprising: a pair of end components configured to magnetically couple to two running rails; and a central unit connected to the pair of end components via electrical wires, wherein the central unit sends a signal to an operations control center (OCC) to indicate a presence of the shunt device.

2. The shunt device of claim 1, wherein each of the pair of end components comprises:

a magnet for coupling to a running rail; and a handle attached to the magnet for operation by a rail worker to attach the magnet to the running rail or to remove the magnet from the running rail.

3. The shunt device of claim 1, wherein the central unit comprises a transmitter configured to wirelessly transmit signals to the OCC in a frequency band near about 220 MHz.

4. The shunt device of claim 1, wherein the central unit comprises one or more transceivers configured to wirelessly communicate with the OCC over a global positioning system (GPS) link or over a cellular link.

5. The shunt device of claim 1, wherein the central unit is configured to communicate, in accordance with positive train control (PTC) technologies, near at least one of the following representative frequencies: 430 MHz, 220 MHz, 900 MHz, and 2.4 MHz.

6. The shunt device of claim 1, wherein communicating with the OCC comprises sending signals to a wayside communication system, which in turn relays the signals to the OCC to indicate the presence of the shunt device.

7. The shunt device of claim 1, wherein the central unit comprises a signaling mechanism configured to indicate whether the shunt device is installed and operational.

8. The shunt device of claim 7, wherein the signaling mechanism comprises a green light that verifies an operational status of the shunt device, and wherein the green light is activated after an electrical connection is formed between the two running rails and after the shunt device is turned on.

9. The shunt device of claim 1, wherein the central unit comprises at least one of visual and audio alarm components configured to warn surrounding rail personnel of a condition in which the shunt device is not properly connected to the two running rails.

10. The shunt device of claim 1, wherein the central unit comprises a transmitter configured to send a radio frequency (RF) signal to one or more wayside devices or personal alert devices, and wherein the RF signal provides warning to nearby rail workers in an event that the shunt device is disconnected from at least one of the rails without proper authorization.

11. The shunt device of claim 1, wherein communicating with the OCC comprises sending a signal to the OCC for distinguishing the shunt device from rail vehicles that also communicate with the OCC.

12. The shunt device of claim 11, wherein the central unit comprises on-board circuitry configured to:

alternatively switch, on and off, an electrical connection of the shunt device to the two running rails; and generate the signal to be sent to the OCC, the signal being generated based on the alternative switching of the electrical connection to specify an identity of the shunt device.

13. A method of using a shunt device for positive train control (PTC)-compatible rail communications, the method comprising:

magnetically coupling the shunt device to two rails of a railroad;

transmitting signals, from the shunt device to an operations control center (OCC), that indicate a presence of the shunt device.

14. The method of claim 13, further comprising:

indicating an operational status of the shunt device using a signaling mechanism located thereon; and issuing warnings to surrounding rail workers when the shunt device stops being properly connected to both rails.

15. The method of claim 13, further comprising, prior to magnetically coupling the shunt device to the two rails, contacting the OCC, by a designated work crew coordinator, to request permission to install the shunt device, wherein for the request the designated work crew coordinator reports to the OCC information including a radio number, a location of work zone, a number of onsite workers, and nature of work.

16. The method of claim 13, further comprising:

verifying that the shunt device is operational after magnetically coupling the shunt device to both rails, the verification being performed by a rail employee located at the OCC based on a Track Occupancy Light (TOL) displayed at the OCC; and granting access, by the rail employee at the OCC, to a work crew to enter a work zone based upon the verification, the shunt device being deployed in the work zone.

17. The method of claim 13, further comprising:

contacting the OCC, by a designated work crew coordinator, to request permission to remove the shunt device;

removing, by the designated work crew coordinator, the shunt device based upon receiving permission from the OCC; and after removal of the shunt device, verifying with the OCC, by the designated work crew coordinator, that a Track Occupancy Light (TOL) corresponding to the shunt device is off.

18. A positive train control (PTC)-compatible failsafe shunt device deployed on a railroad, the shunt device comprising: first and second end components configured to electrically connect to first and second rails of the railroad, respectively; first and second electrical wires connected to the first and second end components, respectively; and a central unit connected to the first and second end components via the first and second electrical wires, wherein the shunt device sends a signal, directly or indirectly, to a control center to indicate a presence of the shunt device.

19. The shunt device of claim 18, wherein at least one of the first and second end components comprises a magnet configured to magnetically couple to a rail, and wherein communication with the control center distinguishes the shunt device from rail vehicles.

20. The shunt device of claim 18, wherein the central unit is configured to wirelessly transmit signals to the control center over at least one of the following communication links: a 220 MHz radio link, a global positioning system (GPS) link, and a cellular link.

* * * * *